United States Patent [19]

Taniguchi

[11] Patent Number: 4,579,068

[45] Date of Patent: Apr. 1, 1986

[54] MELTING SYSTEM

[75] Inventor: Hirotoshi Taniguchi, Komaki, Japan

[73] Assignee: Japan Foundry Service Co., Ltd., Komaki, Japan

[21] Appl. No.: 667,112

[22] Filed: Oct. 30, 1984

[30] Foreign Application Priority Data

Jul. 23, 1984 [JP] Japan ..... 59-111495[U]

[51] Int. Cl.[4] ..... F23D 1/00

[52] U.S. Cl. ..... 110/263; 110/110; 110/182.5; 266/265

[58] Field of Search ..... 110/347, 263, 110, 101 CF, 110/293, 182.5; 266/265

[56] References Cited

U.S. PATENT DOCUMENTS 2,103,453 12/1937 Graemiger ..... 110/347 X
3,150,962 9/1964 Pearson ..... 110/347 X
4,331,084 5/1982 Fitch et al. ..... 110/101 CF
4,349,331 9/1982 Floter ..... 110/347 X
4,380,202 4/1983 LaRue et al. ..... 110/347 X

*Primary Examiner*—Edward G. Favors
*Attorney, Agent, or Firm*—Browdy and Neimark

[57] ABSTRACT

A melting system which is constructed of a melting furnace having a substantially cylindrical furnace body, a blast pipe for introducing air from a pre-arranged air supply source into the furnace body, a particle carbon material supplying apparatus, a particle carbon supplying conduit with an outlet in the tuyere, a screw type material discharging equipment, disposed under the particle carbon supplying apparatus, being connected to the tuyere, and a branch pipe branched off the blast pipe and connected to the particle carbon supplying conduit. This characteristic branch pipe is provided with, in the middle way thereof, a pressure giving device and preferably a bypass passage bypassing the pressure giving device.

7 Claims, 2 Drawing Figures

MELTING SYSTEM

BACKGROUND OF THE INVENTION

This invention relates to a melting system, and particularly a melting system wherein predetermined amount of particle carbon material is supplied into a furnace body of melting furnace for being burnt there so as to melt the material-to-be melted by the combustion heat.

In melting furnaces such as blast furnace, cupola and so on, it has been customary to charge raw iron like iron ore or scrap in the furnace body together with carbon material, before blowing there into air, and melt the raw iron with the heat from combustion of the carbon material. It has however been a great problem in this kind of furnace operation that the cost for the carbon material is so expensive as to inevitably raise the cost of furnace operation. Studies for reducing the carbon material cost have been made in many quarters in this field.

SUMMARY OF THE INVENTION

The present invention was made with such a background as its basis. In other words, it is a principal object of this invention to reduce the cost for the melting operation. It is another object of this invention to provide a concrete means for solving the problem. In the invented means, i.e., a melting system, particle carbon is used as the carbon material and a unique mechanism, for supplying the carbon material into a furnace body to be burnt there, is adopted.

A melting system according to this invention for solving the problem comprises a melting furnace having a substantially cylindrical furnace body, a blast passage means for introducing the air supplied from a pre-arranged air supply source to the furnace body, a particle carbon supplying means for supplying a predetermined amount of particle carbon to the furnace body, and a conduit means for introducing the particle carbon from the particle carbon supplying means into the furnace body; the aforementioned blast passage means is, as a great feature of this invention, provided with a branch passage means for partially dividing the air flow in the blast passage means there-into, and the branch passage means is further connected to the conduit means such that the divided or branched air flow is introduced into the conduit means. According to this invented system, the air flowed into the conduit means can be, together with the carbon material from the particle carbon supplying means, charged into the furnace body.

In such a melting system of this invention, there is an embodiment wherein an outlet opening of the conduit means is situated in a tuyere of the furnace body such that the particle carbon and the air supplied through the conduit means can be introduced into the furnace body, passing through the outlet opening, mixed with the air coming through the blast passage means.

A further preferred embodiment of this invention comprises a melting furnace having a substantially cylindrical furnace body, a blast passage means for introducing the air from a pre-arranged air supply source into the furnace body, a particle carbon supplying means for supplying a predetermined amount of particle carbon to the furnace body, a conduit means for introducing the particle carbon from the particle carbon supplying means into the furnace body, a screw type material discharging means, for pushing or thrusting out the particle carbon, disposed in the lower portion of a particle carbon container of the particle carbon supplying means, a branch passage means which is branched off the blast passage means for partially branching off the air flowed through the blast passage means, and a pressure giving or compressing means for giving the air in the branch passage means some pressure, whereas the pressurized air from the pressure giving means is then introduced into the conduit means so as to be able to act on the particle carbon material pushed out of the screw type material discharging means.

In a further modified type of this invention, the aforementioned screw type discharging means comprises a driving motor, a rotary shaft driven by the motor, and a coil spring concentrically fixed on the rotary shaft.

In another variation type of this invention the said pressure giving or compressing means is a blower.

In still another variation of this invention a bypass means is provided in the branch passage means for bypassing the compressing means.

In one modification of this invention the particle carbon container is constituted of a tightly closed hopper, and the inside of the hopper is communicated with the branch passage means downstream the compressing means such that the air pressure in the branch passage means acts on the particle carbon in the hopper.

In still another modification of this invention the melting furnace is a cupola.

Functions and merits of those various types of melting furnace will be mentioned hereunder. The particle carbon can be in such furnaces supplied by a preset amount from the particle carbon supplying means, and through the conduit means into the furnace body. Since it has thus become possible to supply the carbon material, in such a particle or fine grain state, into the furnace body, the inside temperature of the furnace can be raised quickly responding to the supplying of the carbon material, with a result of facilitating the temperature adjustment in the furnace.

As the combustion efficiency of the particle carbon is high, and consequently the temperature raising rate in the furnace is also high, not only the amount of consumed carbon can be economized but also lower grade of the material carbon becomes permissible. It greatly contributes to the reduction of the cost for the melting operation. Particularly in case of a cupola for melting raw iron, temperature raising in the furnace is so easy that larger mixing rate of scrap as the raw iron may be allowed. It contributes, on the other hand, to the lowering of the material cost. Still another merit resides in enhancing the yield rate of ferrosilicon, due to the enrichment of CO in the furnace. More specifically, the enrichment of CO in the furnace will help increasing the reduction capability of the atmosphere there and thereby restraining the oxidation wastage of the ferrosilicon which is added, in the furnace such as a cupola, for the purpose of composition adjustment of the metals to be melted.

The above described melting system according to this invention is furthermore able to, as a great feature thereof, introduce the particle carbon and the air for the combustion therein constantly at a suitable amount.

About this problem more thorough description is needed, as it contains a large and controversial problem.

The air amount to be introduced into the melting furnace through the blast passage means should be, in general, adjusted from moment to another so that it may be suited in response to the furnace inside conditions such as pressure, temperature, etc. The air amount however tends to be deviated, when the particle carbon is used, irregularly from the justly adjusted level.

When particle carbon is used as the carbon material, pressurized air with a compressor, etc. is generally acted on the particle carbon so as to blow it into the furnace, and the size of the pressure given by the compressor at this time must be determined taking the criterion on the maximum pressure in the furnace. That is because the particle carbon must by all means be surely supplied even when the pressure in the furnace is at the peak. This way of determining the pressure of the compressed air inevitably sends, when the furnace inside pressure is lowered, an excessive amount of air into the furnace all at once. This sudden supply of too much air, into the furnace, over the desirable amount will cause an accompanying supply of excessive amount of the particle carbon, with a result of problematic imperfect combustion of the carbon material.

In a melting system according to this invention the above-mentioned problem can be favorably avoided because of the unique structure mentioned below. That is to say, a part of the air flowed through the blast passage means into the furnace is partially branched off; and the dividedly branched flow of the air is led to the conduit means for sending the particle carbon in the said conduit means together therewith into the furnace body. As the pressure of the air in the blast passage means is constantly controlled so as to be at an appropriate level in response to the pressure in the furnace body, it is naturally lowered when the pressure in the furnace body is lowered by any chance. This mechanism advantageously prevents the sudden excessive supply of air and particle carbon from the conduit means into the furnace. In other words, the pressure of the air introduced to the conduit means is variable in harmony with the pressure in the furnace; it makes it possible to keep the air amount supplied to the furnace through the conduit means at an appropriate level. This consequently keeps the amount of the particle carbon supplied to the furnace at an appropriate level. The combustion condition in the furnace can therefore be kept at a desirable status.

Another important merit of this invented system can be observed in the mechanism of utilizing a part of the air in the blast passage means as a medium for transporting the particle carbon: the transportation of the particle carbon can be performed by the application of a small driving force; the controlling of the whole amount of the air in the furnace system can be easily done, because all of the air introduced into the furnace body is limited to the air flowed through the blast passage means.

In addition to the above-mentioned structures, another mechanism is also thinkable wherein:

as a means for discharging a predetermined amount of the particle carbon from the particle carbon container of the particle carbon supplying means into the conduit means, the container is separately disposed from the conduit means such that the particle carbon is dropped or introduced from the container into a passage of the conduit means and the dropped particle carbon is transported by the pressurized air.

This mechanism can not however be free from a problem:

it is required herein to make the whole system of the particle carbon supplying into a tightly closed one, by means of for example enclosing the whole by walls; it consequently obliges to introduce the pressure of the air in the branch passage means into the tightly enclosed system, otherwise the particle carbon will surely be dispersed outside, due to the pressurized air acting on the conduit means, through the gap formed between the container and the conduit means.

On the contrary, in a preferrable embodiment of this invention, the above-mentioned disadvantage is completely averted by the disposition of the screw type discharging means in the lower portion of the container. Since there is no gap formed between the container and the conduit means, from which the particle carbon may fly away, it is not necessary to take such a troublesome measure as mentioned above.

Besides, as the particle carbon used in this invention, granulated or powdered coal, coke, etc., can be enumerated. They are generally put in use at the particle size (particle diameter) not more than 3 mm, and more specifically not more than 1 mm is widely practiced. The most preferable or ideal particle carbon material in the practical use is said that substantial part of the particles are within the range between 32 mesh and 200 mesh.

BRIEF DESCRIPTION OF THE DRAWINGS

The foregoing and other objects, features and advantages of the present invention will become more apparent from reading the following description of preferred embodiments taken in connection with the accompanying drawing in which.

DETAILED DESCRIPTION OF THE PREFERRED EMBODIMENTS

Referring to the accompanying drawing illustrating preferred embodiments of the present invention, the arrangement of the invention will be described in detail.

Figure 1:
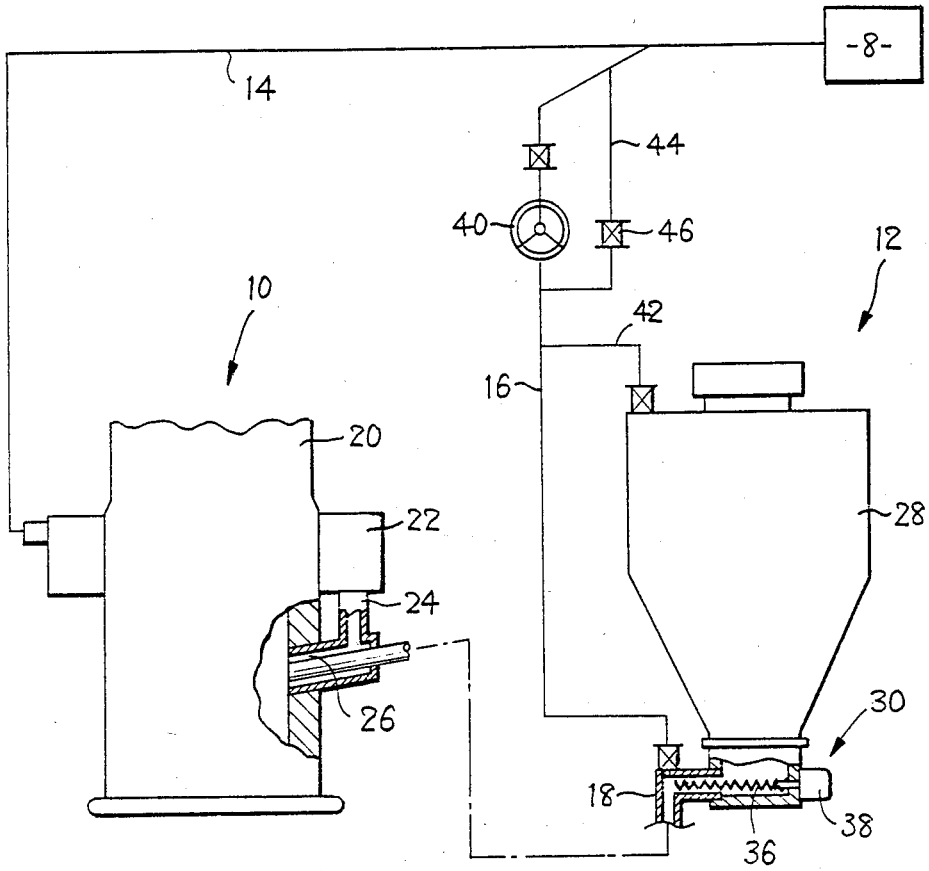
FIG. 1 is a schematic diagram of a cupola system which is an embodiment of this invention.

In FIG. 1 a cupola system as a melting system is schematically illustrated. The cupola system comprises a cupola 10, a particle carbon supplying apparatus 12 for supplying a predetermined amount of the particle carbon, a blast pipe 14 for introducing air for combustion from an air supply source 8 into the cupola 10, a branch pipe 16 branched from the blast pipe 14, and a particle carbon supplying conduit 18 as a passage for the particle carbon which connects the particle carbon supplying apparatus 12 and the cupola 10. The cupola 10 of an ordinary type used for melting metals for castings includes a substantially cylindrical furnace body 20 made of refractory materials, having on the upper portion thereof a charging opening for the material-to-be-melted, and at the lower portion thereof an outlet for the molten pig iron and an outlet for the slag, and a wind box 22 for holding the air introduced through the blast pipe 14. An air supply conduit 24 is extended from the wind box 22, the tip of which reaches a tuyere 26. The air accommodated and held in the wind box 22 is blown into the furnance body 20 through the tuyere 26.

Figure 2:
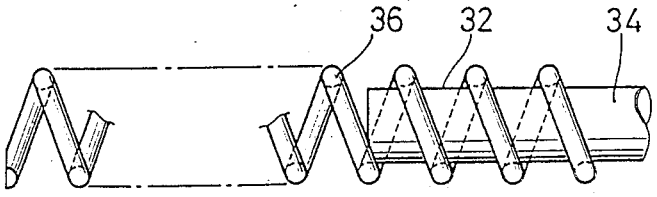
FIG. 2 is an enlarged front elevation of an essential part of the screw-type discharging means.

The particle carbon supplying apparatus 12 is, on the other hand, provided with a tank 28 accommodating the particle carbon and a screw type discharging equipment 30 disposed in the lower portion of the tank 28. Rotation of a screw 32 around the axis will thrust out the particle carbon material into the particle carbon supplying conduit 18 at a predetermined amount. The screw 32 in the screw type discharging equipment 30 is composed of, as clearly illustrated in FIG. 2, a rotary shaft 34 and a coil spring 36 fixed on the tip of the rotary shaft 34. And the screw 32 is rotatable due to the driving force of a motor 38. The particle carbon supplying conduit 18 extends from the lower portion of the tank 28 such that the tip thereof reaches as far as the tuyere 26 of the aforementioned cupola 10 for introducing the particle carbon discharged from the tank 28 to the tuyere 26.

The branch pipe 16 which is branched off from the blast pipe 14 is connected to the particle carbon supplying conduit 18 with the object of introducing a part of the air for combustion, which is flowing in the blast pipe 14 under a certain constant pressure, into the particle carbon supplying conduit 18. In the middle course of the branch pipe 16 a ring blower 40 is disposed for giving some pressure to the air introduced into the branch pipe 16 before it is supplied to the particle carbon supplying conduit 18. The pressurized air in the ring blower 40 is partially introduced to the top of the tank 28 by way of a communication passage 42. Equalizing the pressure level, in the particle carbon supplying conduit 18 and in the tank 28, results in ensuring the smooth flow of the particle carbon from the tank 28 to the particle carbon supplying conduit 18 under the pressurized air flow introduced to the conduit.

The branch pipe 16 is also provided with a bypass pipe 44 for bypassing the ring blower 40. It is therefore allowed to return a part of the pressurized air at the ring blower 40, by means of operating a valve 46 disposed midway the bypass pipe 44, upstream the branch pipe 16 than the ring blower 40.

In a cupola of the above-mentioned structure, the air for combustion supplied by the air supply source 8 is stored once in the wind box 22, and then blown through an air supply conduit 24 and the tuyere 26 into the furnace body 20. On the other hand, a certain predetermined amount of the particle carbon is sent out from the tank 28 of the particle carbon supplying apparatus 12, in response to the rotation speed of the screw 32, into the particle carbon supplying conduit 18. The discharged particle carbon is introduced, together with the pressurized air led into the particle carbon supplying conduit 18, to the tuyere 26 and further into the furnace body 20. In other words, the particle carbon discharged into the particle carbon supplying conduit 18 can be supplied, due to the accompanying action of the air flow which has been branched off the blast pipe 14 for being pressurized by the ring blower 40 and returned via the conduit back to the furnace body 20, into the furnace body 20.

If and when the pressure of the air coming out of the ring blower 40 exceeds the appropriate pressure for supplying a required amount of the particle carbon, it can be adjusted by the operation of the valve 46 on the bypass pipe 44, for partially returning the pressurized air upstream the blower, until the pressure descends to a proper level.

In a cupola system of this structure various advantages can be observed as undermentioned. Since the combustion efficiency of the particle carbon sent in the furnace body 20 is high and the furnace inside temperature is consequently raised, the amount of the particle carbon can be economized. Besides, even low grade carbon such as waste coal can be burnt as the particle carbon, which contributes accompanied by the above-mentioned merit to the reduction of the melting operation cost. Another merit of the melting system of this type, wherein the particle carbon is supplied into the furnace body 20 by the air, is, in addition to the advantageous facilitation of the supply amount adjustment of the carbon material, gradual replacing of pig material by the inexpensive scrap according to the temperature rising in the furnace. This mixing rate increase of the scrap effectively lowers the material cost. One noticeable secondary merit of this device is enhancing of the yield rate of ferrosilicon used in the furnace body 20 for the composition adjustment of the metals to be melted. The ferrosilicon is usually charged, as an additive, with the anticipation of oxidation wastage to a certain extent. However, enrichment of CO in this kind of furnace restrains the wearing of the ferrosilicon due to gradual rising of the reduction capability in the furnace atmosphere.

Another merit of this cupola system is stabilization of the air amount blown into the furnace body 20 and the carbon amount supplied into the furnace body 20. The stabilizing function of the air and carbon, well prevented from irregular fluctuation off the predetermined level, is brought about by undermentioned advantageous device. Since the pressure in the blast pipe 14 is controlled so as to be able to constantly supply appropriate amount of air in response to the conditions in the furnace body 20, the pressure of the air which is introduced through the branch pipe 16 for transporting the particle carbon, to the particle carbon supplying conduit 18, is made variable in harmony with the furnace inside pressure while being kept at a certain amount higher level than the furnace inside pressure. That is to say, the difference between the furnace inside pressure and the pressure of the air introduced to the particle carbon supplying conduit 18 can not be irregularly fluctuated. It makes it possible to supply substantially constant amount of air into the furnace body 20, and consequently keep the amount of particle carbon at a certain predetermined level, with a result of maintaining the combustion conditions in the cupola 10 appropriate.

Further merits of this system are economization of the energy cost for transporting the particle carbon and facilitation of adjustment of the air amount coming from the blast pipe 14 for being brought into the furnace body 20. Two of those merits are caused by the utilization of a part of the air flowing in the blast pipe 14 as the medium for transporting the particle carbon.

The reason and merit of adopting the above-mentioned screw type discharging equipment 30 will be explained next. When an ordinary screw, having a spiral fin disposed around a rotary shaft, the fin or ridge is apt to be rapidly worn. The screw in this invention is very advantageous in restraining the wear thereof. Although it is not necessarily easy to reason the restraining effect of this type screw, hollow structure of the screw and elastic deformability of the spring 36 working as the fin could probably be attributed thereto. Besides, it is added here that the screw type discharging means of this kind is sufficiently effective in its thrusting-out capability.

The above description was made focusing on one embodiment alone. This invention is however applicable to many different styles. For example, means for pressuring the air branched off the blast passage means is not limited to the ring blower, but other types of blower may be allowed. Cupola which the present invention may be applied to is not limited to the one in the aforementioned embodiment, but a variety of cupolas are also permissible.

This invention can be reduced to practice in a variety of modifications and variations, without departing from the scope and spirit of the invention, based on the knowledge of those skilled in the art. The invention is, for example, also applicable to a blast furnace for melting ores.

What is claimed is:

1. A melting system including a melting furnace having a substantially cylindrical furnace body, a blast passage means for introducing air from a pre-arranged air supply source into said furnace body, a particle carbon supplying means for supplying a predetermined amount of particle carbon, and a conduit means for introducing the particle carbon supplied from said particle carbon supplying means into said furnace body, said system comprising:

branch passage means, branched from said blast passage means and connected to said conduit means, for partially dividing the air flowing through said blast passage means thereinto, means, located in said branch passage means, for pressurizing the air divided from said blast passage means, and said particle carbon supplying means including a container comprising a tightly closed hopper, the inside of said hopper communicating with said branch passage means downstream of of said pressurizing means such that the pressure of the air in said branch passage means acts on the particle carbon in said hopper, whereby said divided air is introduced into said conduit means such that the air is charged into said furnace body together with the particle carbon coming from particle carbon supplying means.

2. A melting system according to claim 1, wherein an outlet opening of said conduit means is situated in a tuyere of said furnace body such that the particle carbon and the air supplied through said conduit means are blown into said furnace body, through said outlet opening, together with the air from said blast passage means.

3. A melting system including a melting furnace having a substantially cylindrical furnace body, a blast passage means for introducing air from a pre-arranged air supply source into said furnace body, a particle carbon supplying means for supplying a predetermined amount of particle carbon, and a conduit means for introducing the particle carbon supplied from said particle carbon supplying means into said furnace body, said system comprising:

a screw type discharging means, disposed in the lower portion of a particle carbon container of said particle carbon supplying means, for discharging a predetermined amount of said particle carbon due to its rotation about the axis thereof;

a branch passage means, branched from said blast passage means, for partially dividing the air flowing through said blast passage means thereinto;

a pressure giving means disposed on the branch passage means for pressurizing the air divided in said branch passage means, said particle carbon container of said particle carbon supplying means comprising a tightly closed hopper and the inside of said hopper being in communication with said branch passage means downstream of said pressure giving means such that the pressure of the air in said branch passage means acts on the particle carbon in said hopper, wherein the pressurized air from said pressure giving means is led to said conduit means so as to act on the particle carbon such that said particle carbon is supplied into said furnace body together with said pressurized air.

4. A melting system according to claim 3 wherein said screw type discharging means comprises a driving motor, a rotary shaft which is rotated by said motor, and a coil spring concentrically fixed on said rotary shaft.

5. A melting system according to claim 3 wherein said pressure giving means is a blower.

6. A melting system according to claim 3 wherein said branch passage means comprises a bypass means disposed in said branch passage means.

7. A melting system according to claim 3 wherein said melting furnace is a cupola.

* * * * *